US012679590B2

(12) United States Patent
Cooke et al.

(10) Patent No.: US 12,679,590 B2
(45) Date of Patent: Jul. 14, 2026

(54) CONTAINER WITH DIVIDER

(71) Applicant: Graphic Packaging International, LLC, Atlanta, GA (US)

(72) Inventors: Liam Cooke, Leicestershire (GB); Jamie Skipper, Leicester (GB)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 18/805,998

(22) Filed: Aug. 15, 2024

(65) Prior Publication Data

US 2025/0058928 A1 Feb. 20, 2025

Related U.S. Application Data

(60) Provisional application No. 63/541,446, filed on Sep. 29, 2023, provisional application No. 63/533,393, filed on Aug. 18, 2023.

(51) Int. Cl.
*B65D 5/4805* (2006.01)
*B65D 5/04* (2006.01)

(52) U.S. Cl.
CPC ..... *B65D 5/48022* (2013.01); *B65D 5/04* (2013.01)

(58) Field of Classification Search
CPC ..... B65D 5/48022; B65D 5/04; B65D 5/563; B65D 5/603; B65D 5/321; B65D 5/2047;
(Continued)

(56) References Cited

U.S. PATENT DOCUMENTS 2,110,681 A 3/1938 Rutledge
2,334,805 A 11/1943 Barbieri
(Continued)

FOREIGN PATENT DOCUMENTS

CA 2814149 A1 4/2012
CA 2988665 C 6/2020
(Continued)

OTHER PUBLICATIONS

Compartment K&K Paper Tray 2100mi, available Apr. 28, 2023, [online], [site visited Apr. 28, 2023]. Available from internet, URL: https://goodwillretail.co.th/ehop/2-compartment-kk-paper-tray-2100ml/ (Year: 2023) 1 page.
(Continued)

*Primary Examiner* — Christopher R Demeree
(74) *Attorney, Agent, or Firm* — Andrew N. Claerbout; FisherBroyles, LLP

(57) ABSTRACT

A container for holding one or more articles. The container can comprise a base comprising one or more bottom panels and one or more divider panels and a crown comprising a flange panel. A bottom wall can comprise at least the one or more bottom panels and a sidewall can comprise at least a portion of the base and at least a portion of the crown. The sidewall and the bottom wall can extend along an interior of the container. A flange can comprise the flange panel, and the flange can extend outwardly from the sidewall. A divider can comprise the one or more divider panels, and the divider can extend upwardly from the bottom wall into the interior of the container.

40 Claims, 11 Drawing Sheets

(58) Field of Classification Search
CPC .... B65D 5/28; B65D 81/3453; B65D 5/4266; B65D 5/48002; B65D 7/26; B65D 5/246; A47G 19/02; A47G 23/06
USPC ..... 229/120.17, 903, 905, 169, 120.14, 229/120.16, 114, 125.35, 407; 206/501; 220/555
See application file for complete search history.

(56) References Cited

U.S. PATENT DOCUMENTS 2,663,449 A 12/1953 Smart
3,100,595 A 8/1963 Curtiss
3,104,012 A 9/1963 Beamish
3,154,215 A 10/1964 Le Vesconte
3,224,163 A 12/1965 Ray, II
3,358,900 A 12/1967 Perdue
3,401,498 A 9/1968 Alex
3,489,331 A 1/1970 Andersson
D219,263 S 11/1970 Castelli
3,575,338 A 4/1971 Dilot
3,640,188 A 2/1972 Dilot
D224,662 S 8/1972 Swett
3,823,054 A 7/1974 Balzer
D232,302 S 8/1974 Lazure
3,863,832 A 2/1975 Gordon
3,893,882 A 7/1975 Repenning
3,941,301 A 3/1976 Jorgensen
4,046,310 A 9/1977 Gustafsson
4,057,380 A 11/1977 Hosoe
4,081,125 A 3/1978 Meyers
4,130,236 A 12/1978 Manizza
D251,951 S 5/1979 Florian
4,177,715 A 12/1979 Meyers
4,202,465 A 5/1980 McLaren
D257,109 S 9/1980 Conti
4,241,863 A 12/1980 Faller
4,257,530 A 3/1981 Faller
4,279,354 A 7/1981 Conti
4,283,427 A 8/1981 Winters
4,305,542 A 12/1981 Benzschawel
4,308,985 A 1/1982 Manizza
4,325,905 A 4/1982 Takahashi
4,351,473 A 9/1982 Manizza
4,533,065 A 8/1985 Chazal et al.
4,555,381 A 11/1985 Chazal
4,574,174 A 3/1986 Mcgonigle
D284,727 S 7/1986 Gerber
4,718,596 A 1/1988 Mueller
D302,068 S 7/1989 Forbes, Jr.
4,848,648 A 7/1989 Eisman
4,903,842 A 2/1990 Tokuda
4,943,456 A 7/1990 Pollart
4,944,451 A 7/1990 Forbes, Jr.
5,000,374 A 3/1991 Deiger
5,002,826 A 3/1991 Pollart
5,002,833 A 3/1991 Kinsey, Jr.
5,009,939 A 4/1991 Goldberg
5,118,747 A 6/1992 Pollart
D332,393 S 1/1993 Boone
5,203,491 A 4/1993 Marx
D339,522 S * 9/1993 Zoss ..... D9/425
5,253,801 A 10/1993 Bernstein
5,326,021 A 7/1994 Farrell
5,351,879 A 10/1994 Liu
5,356,070 A * 10/1994 Rigby ..... B65D 5/48022 229/407
5,410,135 A 4/1995 Pollart
5,412,187 A 5/1995 Walters
D363,192 S 10/1995 Reeves
5,484,052 A 1/1996 Pawloski
D367,172 S 2/1996 Brightbill
5,530,231 A 6/1996 Walters
D372,170 S 7/1996 Ahern, Jr.
5,533,622 A 7/1996 Stockley, III
5,533,623 A 7/1996 Fischer
5,538,179 A 7/1996 Cai
5,588,583 A 12/1996 Cargile, Jr.
5,647,168 A 7/1997 Gilbert
D382,230 S 8/1997 Weder
5,921,465 A 7/1999 Garton
D420,855 S 2/2000 Hurley
6,092,687 A 7/2000 Hupp
6,116,501 A 9/2000 Hupp
D434,276 S * 11/2000 Obra ..... D7/549
6,204,492 B1 3/2001 Zeng
6,234,386 B1 5/2001 Drummond
6,237,845 B1 5/2001 Hashimoto
D448,130 S 9/2001 Wagner
6,433,322 B2 8/2002 Zeng
6,552,315 B2 4/2003 Zeng
D482,276 S 11/2003 Wang
D484,364 S 12/2003 Bailey
6,677,563 B2 1/2004 Lai
D549,457 S 8/2007 Dretzka
D581,720 S * 12/2008 Kellermann ..... D7/357
D595,155 S 6/2009 Larson
D633,341 S 3/2011 Smyers
D643,311 S 8/2011 Meyers
D656,789 S * 4/2012 Locke ..... D7/541
D658,933 S 5/2012 Woodard
8,297,437 B2 10/2012 Smalley
D688,572 S 8/2013 Marin
D688,921 S 9/2013 Miros
8,534,460 B2 9/2013 Wnek
D693,180 S 11/2013 Peterson
8,740,051 B2 6/2014 Gonzalez
8,801,995 B2 8/2014 Wnek
D712,153 S 9/2014 Lee
D713,741 S 9/2014 Wilmers
9,376,231 B2 6/2016 Pinkstone
9,463,896 B2 10/2016 Fitzwater
9,783,345 B2 10/2017 Bentham
10,173,805 B2 1/2019 Waddington
10,214,315 B2 2/2019 Oliveira
10,214,334 B2 2/2019 Jones
10,232,973 B2 3/2019 Burke
10,689,147 B2 6/2020 Nikolic
D897,847 S 10/2020 Glassman
11,142,383 B2 10/2021 Thompson
D962,008 S 8/2022 Moore
D964,862 S * 9/2022 Evans ..... D9/761
11,434,038 B2 9/2022 Tye
D970,977 S 11/2022 Glupker
11,603,231 B2 3/2023 Oliveira
11,697,537 B2 7/2023 Holley, Jr.
D1,005,100 S 11/2023 Mondini
11,827,430 B2 11/2023 Brink
11,932,467 B2 3/2024 Ackroyd
D1,042,118 S 9/2024 Hithersay
D1,042,122 S 9/2024 Brink
D1,051,657 S * 11/2024 Sellers ..... D7/354
D1,062,459 S 2/2025 Brink
12,434,893 B2 * 10/2025 Loftin ..... B65D 77/003
2005/0031814 A1 2/2005 Dawes
2007/0116806 A1 5/2007 Parsons
2008/0035634 A1 2/2008 Zeng
2011/0174676 A1 7/2011 Stockhaus
2011/0259784 A1 10/2011 Tye
2012/0248180 A1 10/2012 White
2012/0292226 A1 11/2012 Hilbish
2013/0327819 A1 12/2013 Baker
2013/0327821 A1 12/2013 Zwaga
2014/0124406 A1 5/2014 Ishikawa
2014/0183198 A1 7/2014 Slack
2014/0224866 A1 8/2014 Littlejohn
2015/0225120 A1 8/2015 Wnek
2015/0375889 A1 12/2015 Brockman
2016/0304226 A1 10/2016 Rossini
2017/0341355 A1 11/2017 Peiffer
2018/0022529 A1 1/2018 Tye
2018/0319568 A1 11/2018 Tye
2020/0047940 A1 2/2020 Tye
2020/0047975 A1 2/2020 Tye

(56) References Cited

U.S. PATENT DOCUMENTS

| | | | |
|---|---|---|---|
| 2020/0255200 | A1 | 8/2020 | Mondini |
| 2022/0009669 | A1 | 1/2022 | Mack |
| 2022/0055789 | A1 | 2/2022 | Mero |
| 2022/0289459 | A1 | 9/2022 | Kastanek |
| 2022/0348376 | A1 | 11/2022 | Tye |
| 2024/0150067 | A1 | 5/2024 | Hithersay |
| 2024/0239580 | A1 | 7/2024 | Ahumada |
| 2024/0286790 | A1 | 8/2024 | Kavanagh |
| 2024/0359858 | A1 | 10/2024 | Smith |
| 2025/0320021 | A1 | 10/2025 | Lee |

FOREIGN PATENT DOCUMENTS

| | | | |
|---|---|---|---|
| CN | 203450620 | U | 2/2014 |
| CN | 109153482 | | 1/2019 |
| DE | 19654230 | A1 | 7/1998 |
| DE | 10022552 | | 11/2001 |
| DE | 10111232 | A1 | 9/2002 |
| EM | 8904924 | | 3/2022 |
| EM | 0090908480001 | | 8/2022 |
| EM | 0090908480002 | | 8/2022 |
| EP | 0052021 | A1 | 5/1982 |
| EP | 0052021 | B1 | 1/1985 |
| EP | 0300809 | | 1/1989 |
| EP | 0671332 | A1 | 9/1995 |
| EP | 1089912 | | 4/2001 |
| EP | 1104744 | A2 | 6/2001 |
| EP | 1089912 | B1 | 2/2004 |
| EP | 2441697 | | 4/2012 |
| EP | 3431405 | A2 | 1/2019 |
| EP | 3604154 | A2 | 2/2020 |
| EP | 3725492 | A2 | 10/2020 |
| EP | 3988463 | A1 | 4/2022 |
| FR | 2133727 | | 12/1972 |
| FR | 2406522 | | 5/1979 |
| FR | 2826938 | | 1/2003 |
| FR | 2933329 | | 1/2010 |
| FR | 2975081 | A1 | 11/2012 |
| GB | 1314148 | | 4/1973 |
| GB | 1501764 | | 2/1978 |
| GB | 1602625 | | 11/1981 |
| GB | 2487765 | A | 8/2012 |
| GB | 2550386 | A | 11/2017 |
| JP | H0642636 | | 2/1994 |
| JP | 2000141511 | A | 5/2000 |
| JP | 2000190948 | A | 7/2000 |
| JP | 2001002056 | A | 1/2001 |
| JP | 2001096644 | A | 4/2001 |
| JP | 2001233322 | A | 8/2001 |
| JP | 2001233324 | A | 8/2001 |
| JP | 2001278246 | A | 10/2001 |
| JP | 2002347746 | A | 12/2002 |
| JP | 2006290368 | A | 10/2006 |
| JP | 2006-298395 | A | 11/2006 |
| JP | 2023-007887 | A | 1/2023 |
| JP | 2023007889 | | 1/2023 |
| KR | 101539187 | B1 | 7/2015 |
| RU | 2566318 | C2 | 10/2015 |
| TW | M295475 | U | 8/2006 |
| TW | M301016 | U | 11/2006 |
| WO | 9828195 | A1 | 7/1998 |
| WO | 9967143 | A2 | 12/1999 |
| WO | 2003041945 | | 5/2003 |
| WO | 2007127371 | | 11/2007 |
| WO | 2009138786 | | 11/2009 |
| WO | 2012049005 | A1 | 4/2012 |
| WO | 2013002639 | | 1/2013 |
| WO | 2014032059 | A1 | 2/2014 |
| WO | 2014066867 | A1 | 5/2014 |
| WO | 2015009518 | | 1/2015 |
| WO | 2018017783 | A1 | 1/2018 |
| WO | 2018042210 | A1 | 3/2018 |
| WO | 2018178508 | A1 | 10/2018 |
| WO | 2019020863 | | 1/2019 |
| WO | 2019092323 | A1 | 5/2019 |
| WO | 2019094057 | A1 | 5/2019 |
| WO | 2020033350 | | 2/2020 |
| WO | 2020033352 | | 2/2020 |
| WO | 2021209610 | A1 | 10/2021 |
| WO | 2023283293 | A1 | 1/2023 |
| WO | WO 2023/128768 | A1 | 7/2023 |
| WO | 2024097318 | A1 | 5/2024 |

OTHER PUBLICATIONS

Graphic Packaging adds PaperSealTM Shape. Date first available: Feb. 15, 2023. Site visited: May 6, 2025. Available online: https://www.paperadvance.com/sciences-innovations/paper-advancement/graphic- packaging-adds-paperseal-shape-to-multi-award-winning-tray-range.html (Year: 2023).

International Search Report and Written Opinion for PCT/US2025/036898 dated Nov. 4, 2025, 11 pages.

PaperSeal Original Tray, available Apr. 28, 2023, [online], [site visited Apr. 28, 2023]. Available from internet, URL: https://www.graphicpkg.com/products/paperseal-original/ (Year: 2023), 5 pages.

PaperSealTM Shape Tray for Ready-to-Eat Food. Date first available: Feb. 13, 2023. Site visited: May 6, 2025. Available online: https://www.graphicpkg.com/products/paperseal-shape-tray/ (Year: 2023).

PaperSeal™ Shape Tray for Ready-to-Eat Food. Date first available: Feb. 13, 2023. site visited: Aug. 28, 2025. Available online: https://www.graphicpkg.com/products/paperseal-shape-tray/ (Year: 2023).

International Search Report and Written Opinion for PCT/US2024/042441 dated Dec. 3, 2024.

* cited by examiner

CONTAINER WITH DIVIDER

CROSS-REFERENCED TO RELATED APPLICATIONS

This application claims the benefit of U.S. Provisional Patent Application No. 63/533,393, filed on Aug. 18, 2023, and U.S. Provisional Patent Application No. 63/541,446, filed on Sep. 29, 2023.

INCORPORATION BY REFERENCE

The disclosures of U.S. Provisional Patent Application No. 63/541,446, filed Sep. 29, 2023, U.S. Provisional Patent Application No. 63/533,393, filed Aug. 18, 2023, U.S. patent application Ser. No. 16/037,425, filed Jul. 17, 2018, U.S. patent application Ser. No. 15/654,814, filed Jul. 20, 2017, and U.S. patent application Ser. No. 12/992,131, filed Feb. 11, 2011, are hereby incorporated by reference for all purposes as if presented herein in their entirety.

BACKGROUND OF THE DISCLOSURE

The present disclosure relates to blanks, containers, trays, constructs, and various features and methods for forming a container from a blank. More specifically, the disclosure is generally directed to a container having a liner.

SUMMARY OF THE DISCLOSURE

In general, one aspect of the disclosure is generally directed to a container for holding one or more articles. The container can comprise a base comprising one or more bottom panels and one or more divider panels and a crown comprising a flange panel. A bottom wall can comprise at least the one or more bottom panels and a sidewall can comprise at least a portion of the base and at least a portion of the crown. The sidewall and the bottom wall can extend along an interior of the container. A flange can comprise the flange panel, and the flange can extend outwardly from the sidewall. A divider can comprise the one or more divider panels, and the divider can extend upwardly from the bottom wall into the interior of the container.

In another aspect, the disclosure is generally directed to, in combination, a base blank and a crown blank for forming a container for holding one or more articles. The base blank can comprise one or more bottom panels and one or more divider panels. The one or more bottom panels can be for at least partially forming a bottom wall of the container formed from the base blank and the crown blank, and the one or more divider panels can be for at least partially forming a divider of the container formed from the base blank and the crown blank. The one or more divider panels can be for extending upwardly from one or more bottom panels when the container is formed from the base blank and the crown blank. The crown blank can comprise at least a flange panel for at least partially forming a flange of the container formed from the base blank and the crown blank. At least a portion of the base blank and at least a portion of the crown blank can be for at least partially forming a sidewall of the container formed from the base blank and the crown blank.

In another aspect, the disclosure is generally directed to a method of forming a container for holding one or more articles. The method can comprise obtaining a base blank and a crown blank. The base blank can comprise one or more bottom panels and one or more divider panels, and the crown blank can comprise at least a flange panel. The method further can comprise forming the base blank into a base comprising positioning the one or more bottom panels to at least partially form a bottom wall extending along an interior of the container and forming the crown blank into a crown at least partially overlapping the base. Portions of the crown and the base can cooperate to at least partially form a sidewall extending at least partially around the interior of the container, and the flange panel can at least partially form a flange extending outwardly from the sidewall. The method also can comprise forming a divider comprising positioning the one or more divider panels to extend at least upwardly from the bottom wall.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure relates generally to various aspects of containers, constructs, trays, materials, packages, elements, and articles, and methods of making such containers, constructs, trays, materials, packages, elements, and articles. Although several different aspects, implementations, and embodiments are disclosed, numerous interrelationships between, combinations thereof, and modifications of the various aspects, implementations, and embodiments are contemplated hereby. In one illustrated embodiment, the present disclosure relates to forming a container or tray for holding food items or various other articles. However, in other embodiments, the container or tray can be used to form other non-food containing articles or may be used for heating or cooking. In this specification, the terms “inner,” “interior,” “outer,” “exterior,” “lower,” “bottom,” “upper,” and “top” indicate orientations determined in relation to fully erected and upright packages. As described herein, constructs can be formed from blanks with multiple panels, portions, tabs, and/or flaps, which may be designated herein in terms relative to one another, e.g., "first", "second", "third", etc., in sequential or nonsequential reference, without departing from the disclosure.

Figure 1:
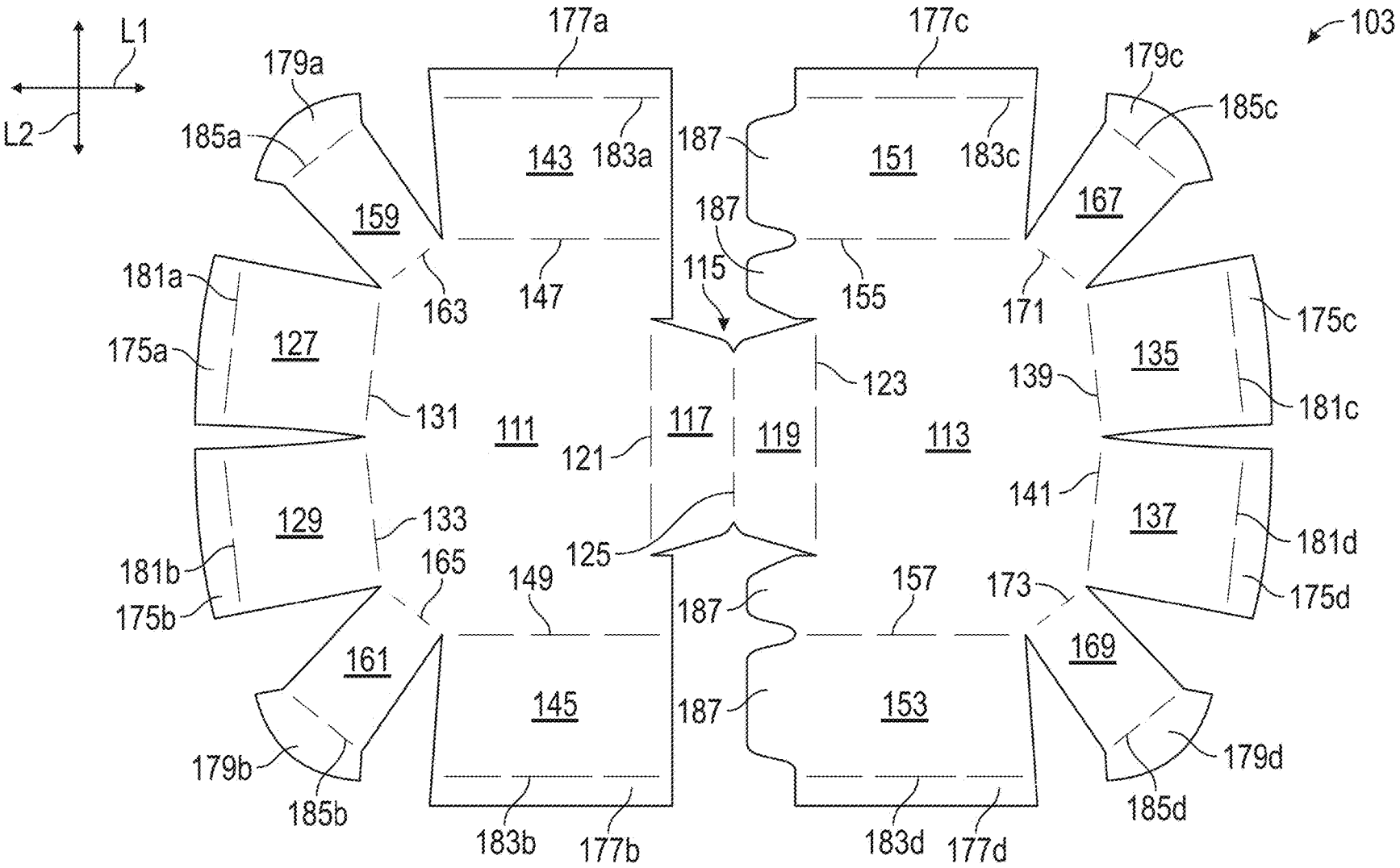
FIGS. 1 and 2 are plan views of a respective first blank and second blank used for forming a container according to exemplary embodiments of the disclosure.
Figure 2:
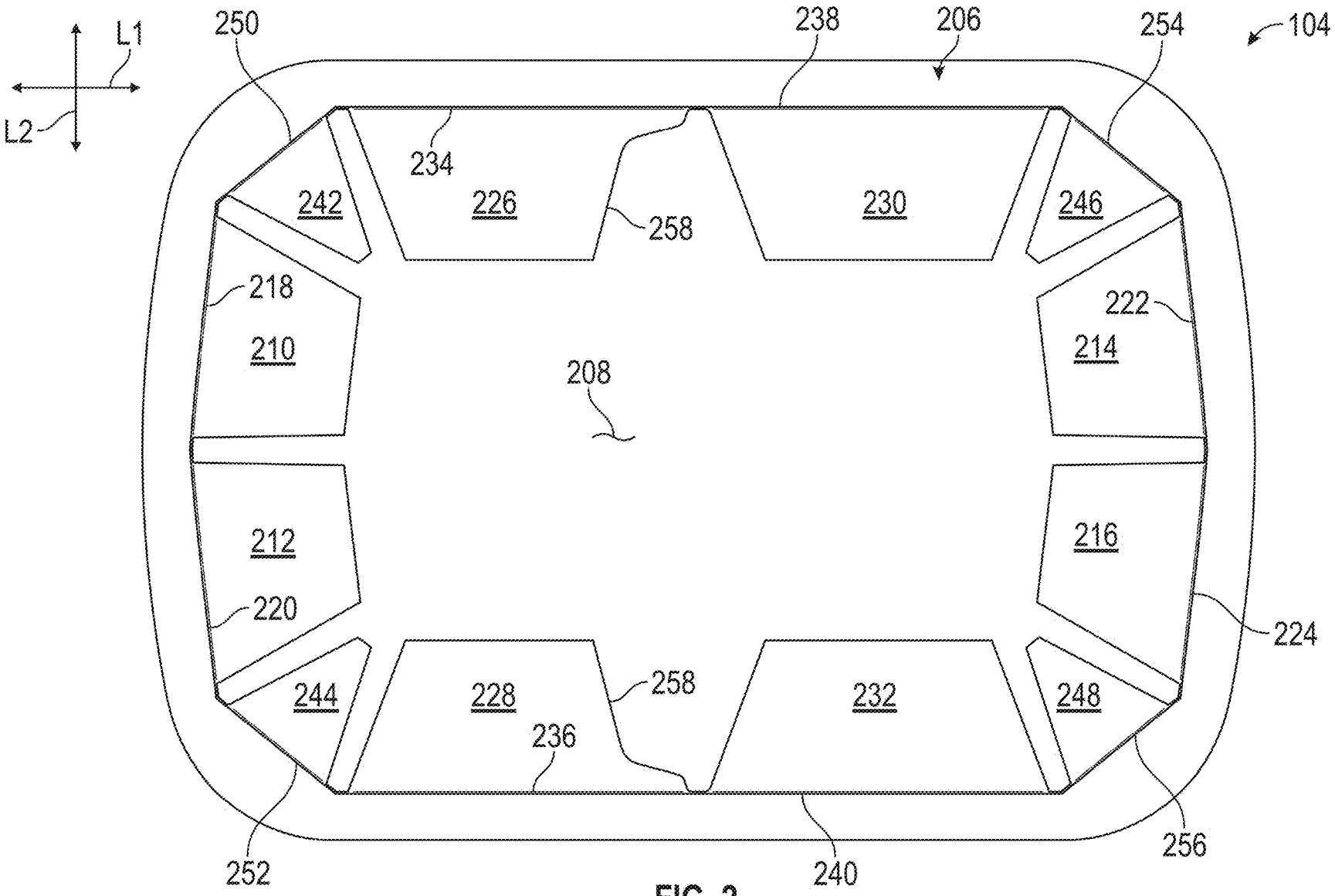

FIGS. 1 and 2 illustrate a first or bottom or base blank 103 and a second or top or crown blank 104, respectively, that are used to form a respective base 101 and crown 102, which cooperate to form a container 105 (FIGS. 3-5) having a base layer 107 and a liner 109 (FIG. 3) according to embodiments of the disclosure. In exemplary embodiments, the blanks 103, 104 and the base layer 107 comprise paperboard (e.g., solid bleached sulphate folding boxboard), or other suitable material that can be recyclable, and the liner comprises a plastic layer such as polyethylene, PET material, or any other thermoplastic material, or a bioplastic, such as vegetable oil or starch-based plastics. The container 105 can be suitable for holding and/or displaying one or more articles (e.g., food products) for sale, transportation, storage, etc. and/or for heating a food product in an oven such as a convection or conventional heating oven or microwave oven. In the illustrated embodiment, the liner can be adhered to the base layer 107 (e.g., along at least a portion of the base 101 and at least a portion of the crown 102) and can be in contact with the food product held in the container 105. After use of the container 105, the base layer 107 and the liner can be separated to allow both the base layer 107 and the liner to be placed in separate waste streams (e.g., for recycling, composting, incineration, land fill, etc.).

As shown in FIG. 1, the base blank 103 has a longitudinal direction L1 and a lateral direction L2. In the illustrated embodiment, the base blank 103 has a first bottom panel 111 and a second bottom panel 113 connected by a divider structure 115. As shown in FIG. 1, the divider structure 115 can include a first divider panel 117 and a second divider panel 119, wherein the first divider panel is foldably connected to the first bottom panel 111 along a lateral fold line 121 and the second divider panel 119 is foldably connected to the second bottom panel 113 along a lateral fold line 123. The first divider panel 117 and the second divider panel 119 can be foldably connected along a lateral fold line 125. The base blank 103 further can include a first end panel 127 and a second end panel 129 foldably connected to the first bottom panel 111 along respective fold lines 131, 133 (e.g., oblique fold lines 131, 133) and a third end panel 135 and a fourth end panel 137 foldably connected to the second bottom panel along respective fold lines 139, 141 (e.g., oblique fold lines 139, 141). As shown in FIG. 1, a first side panel 143 and an opposing second side panel 145 can be foldably connected to the first bottom panel 111 along respective longitudinal fold lines 147, 149, and a third side panel 151 and an opposing fourth side panel 153 can be foldably connected to the second bottom panel 113 along respective longitudinal fold lines 155, 157.

In the illustrated embodiment, the base blank 103 can include corner panels 159, 161 respectively foldably connected to the first bottom panel 111 along respective oblique fold lines 163, 165 and corner panels 167, 169 respectively foldably connected to the second bottom panel 113 along respective oblique fold lines 171, 173. As shown in FIG. 1, the corner panel 159 is disposed between the first end panel 127 and the first side panel 143, the corner panel 161 is disposed between the second end panel 129 and the second side panel 145, the corner panel 167 is disposed between the third end panel 135 and the third side panel 151, and the corner panel 169 is disposed between the fourth end panel 137 and the fourth side panel 153.

In the illustrated embodiments, each of the end panels 127, 129, 135, 137, side panels 143, 145, 151, 153, and corner panels 159, 161, 167, 169 can be foldably connected to a respective flange portion 175*a*, 175*b*, 175*c*, 175*d*, 177*a*, 177*b*, 177*c*, 177*d*, 179*a*, 179*b*, 179*c*, 179*d* along respective fold lines 181*a*, 181*b*, 181*c*, 181*d*, 183*a*, 183*b*, 183*c*, 183*d*, 185*a*, 185*b*, 185*c*, 185*d* (e.g., the flange portions can be portions of the respective end panels, side panels. and corner panels at least partially defined by the respective fold lines). As shown in FIG. 1, the first bottom panel 111, the first side panel 143, and the second side panel 145 can be spaced apart from the second bottom panel 113, the third side panel 151, and the fourth side panel 153 in the blank 103, and overlap tabs 187 can extend from the second bottom panel 113, the third side panel 151, and the fourth side panel 153 toward the first bottom panel 111, the first side panel 143, and the second side panel 145. When the container 105 is formed, the overlap tabs 187 at least partially overlap the first bottom panel 111, the first side panel 143, and the second side panel 145.

The base blank 103 can be otherwise shaped, arranged, and/or configured without departing from the disclosure. In addition, any of the bottom panels 111, 113, the end panels 127, 129, 135, 137, the side panels 143, 145, 151, 153, the corner panels 159, 161, 167, 169, and/or the flange portions 175*a*, 175*b*, 175*c*, 175*d*, 177*a*, 177*b*, 177*c*, 177*d*, 179*a*, 179*b*, 179*c*, 179*d* could be omitted or could be otherwise shaped, arranged, positioned, and/or configured without departing from the disclosure. For example, the base blank 103 could have any suitable number of panels and any suitable shape for the perimeter around the bottom panel 111.

Figure 3:
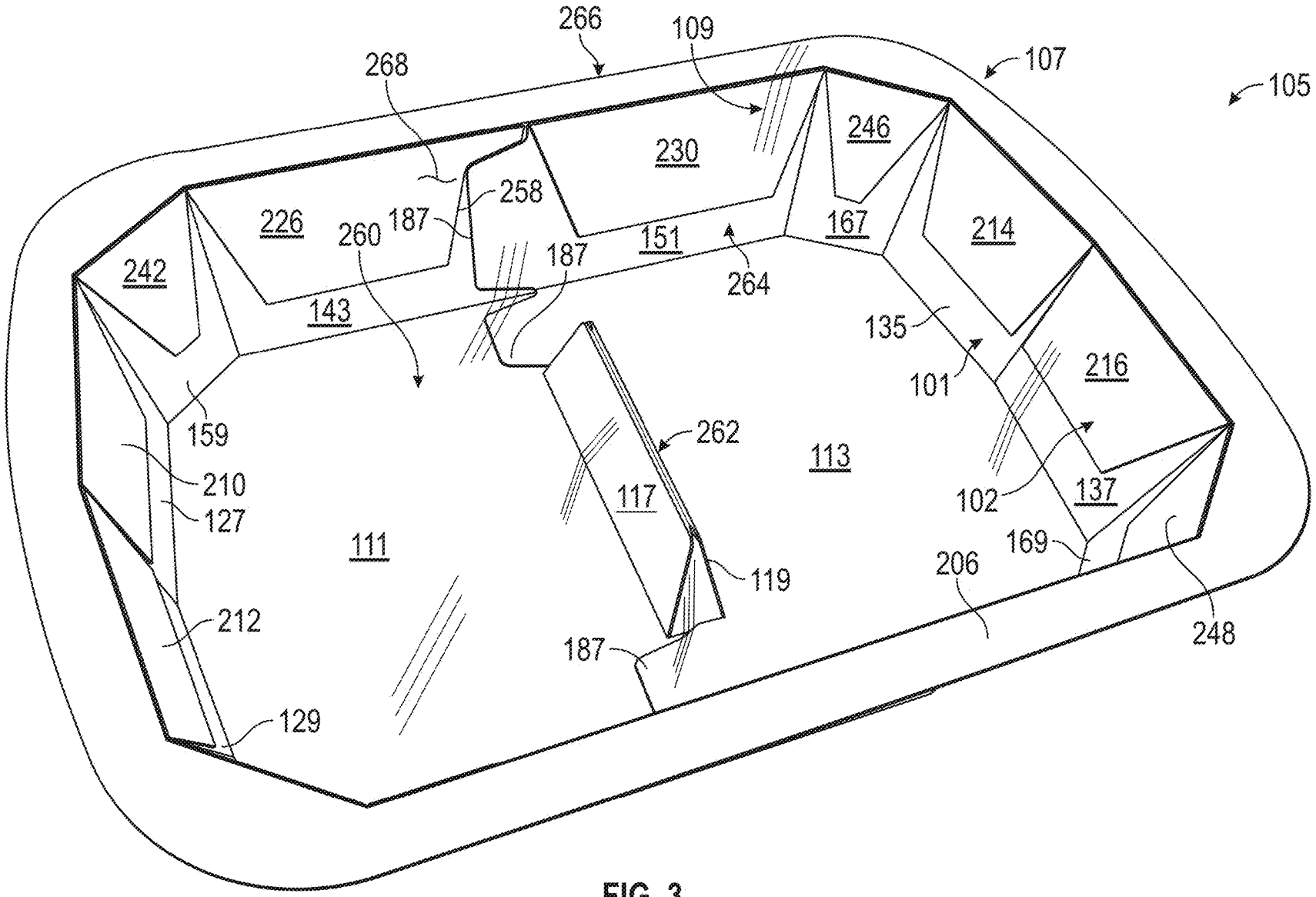
FIG. 3 is a perspective view of the container formed from the blanks of FIGS. 1 and 2 according to exemplary embodiments of the disclosure.
Figure 4:
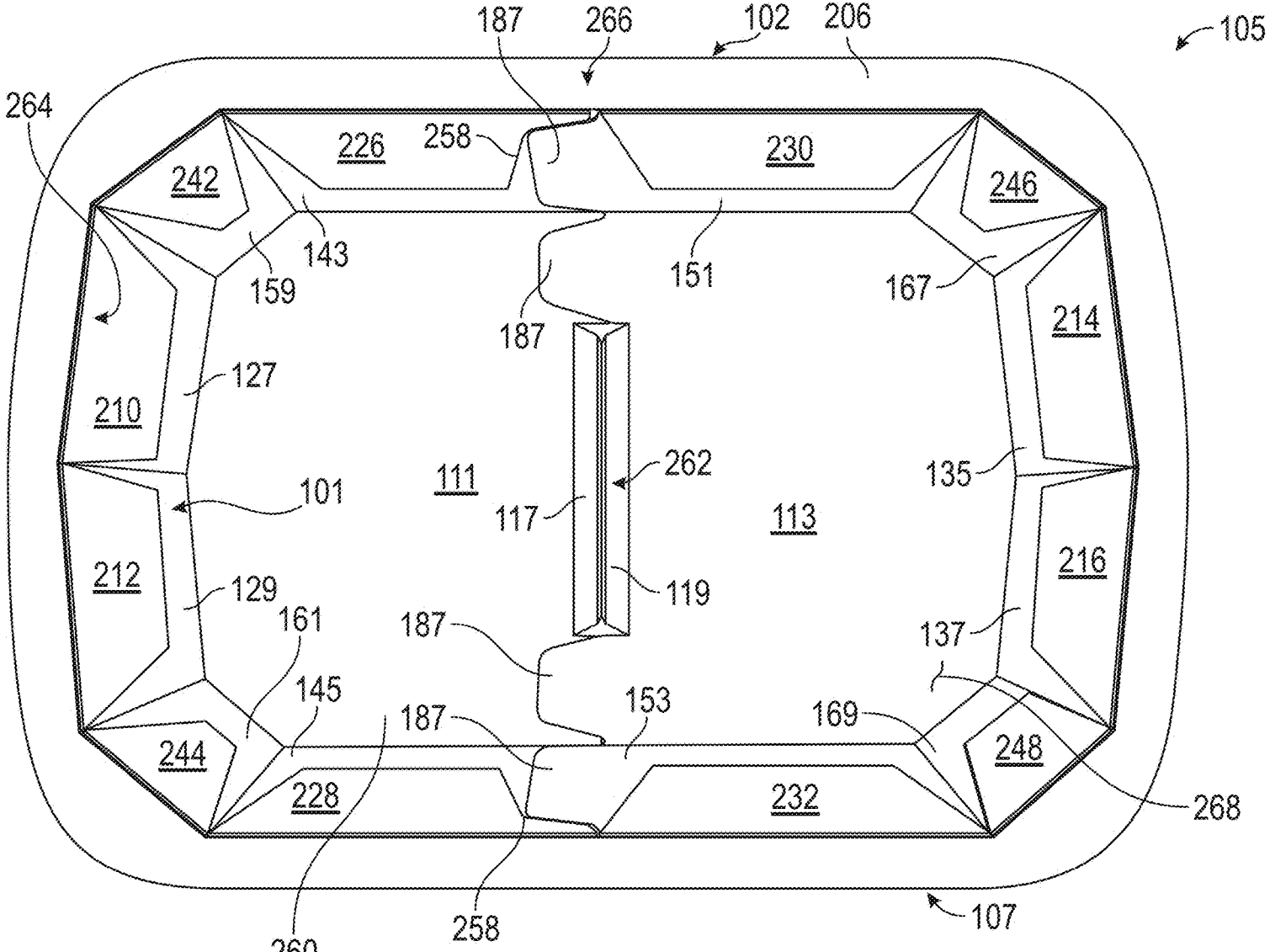
FIG. 4 is a perspective top view of the container of FIG. 3.

As shown in FIG. 2, the crown blank 104 has a longitudinal direction L1 and a lateral direction L2 and includes a flange panel 206 extending around a perimeter of the crown blank 104 (e.g., continuously around the crown blank 104 for forming a smooth, continuous upper surface of the flange of the container 105 for attaching the liner and/or a lid film). In the illustrated embodiments, the crown blank 104 can include a central opening 208 (e.g., at least partially defined by an inner edge of the flange panel 206. A first end flap 210, a second end flap 212, a third end flap 214, and a fourth end flap 216 can be foldably connected to the flange panel 206 along the central opening 208 along respective oblique fold lines 218, 220, 222, 224. As shown in FIG. 2, the blank 104 can include a first side flap 226, a second side flap 228, a third side flap 230, and a fourth side flap 232 foldably connected to the flange panel 206 along respective longitudinal fold lines 234, 236, 238, 240. In the illustrated embodiments, corner flaps 242, 244, 246, 248 can be foldably connected to the flange panel 206 along respective oblique fold lines 250, 252, 254, 256. In embodiments, the first side flap 226, and the second side flap 228 can include respective cutouts 258 for accommodating the overlap tabs 187 extending from the respective third side panel 151 and fourth side panel 153 and overlapping the respective first side panel 143 and second side panel 145 when the container 105 is formed from the base blank 103 and the crown blank 104 (FIGS. 3 and 4).

The crown blank 104 can be otherwise shaped, arranged, and/or configured without departing from the disclosure. In addition, any of the flange panel 206, the end flaps 210, 212, 214, 216, the side flaps 226, 228, 230, 232, and/or the corner flaps 242, 244, 246, 248, could be omitted or could be otherwise shaped, arranged, positioned, and/or configured without departing from the disclosure. For example, the crown blank 104 could have any suitable number of panels and any suitable shape for the perimeter around the central opening 208.

When the container 105 is formed from the base blank 103 and the crown blank 104 (e.g., manually or by a forming tool), the base blank 103 can be formed into the base 101 and the crown blank 104 can be formed into the crown 102. For example, the bottom panels 111, 113 are moved closer together so that the overlap tabs 187 extending from the second bottom panel 113 at least partially overlap the first bottom panel 111 to form a bottom wall 260 (FIGS. 3 and 4). As the bottom panels 111, 113 are moved together, the divider panels 117, 119 are folded upwardly along the lateral fold lines 121, 123 and fold relative to one another along the lateral fold line 125 to form a divider 262 extending upwardly from the bottom wall 260 (FIGS. 3 and 4). The panels 127, 129, 135, 137, 143, 145, 151, 153, 159, 161, 167, 169 can be folded upwardly relative to the bottom panels 111, 113 along their respective fold lines, and the flange portions 175*a*, 175*b*, 175*c*, 175*d*, 177*a*, 177*b*, 177*c*, 177*d*, 179*a*, 179*b*, 179*c*, 179*d* can be folded outwardly relative to the respective panels 127, 129, 135, 137, 143, 145, 151, 153, 159, 161, 167, 169. In the illustrated embodiment, the overlap tabs 187 extending from the side panels 151, 153 can overlap the side panels 143, 145 (FIGS. 3 and 4). The panels 127, 129, 135, 137, 143, 145, 151, 153, 159, 161, 167, 169 and the flange portions 175*a*, 175*b*, 175*c*, 175*d*, 177*a*, 177*b*, 177*c*, 177*d*, 179*a*, 179*b*, 179*c*, 179*d* can be positioned before, after, or during the forming of the bottom wall 260 and the divider 262.

The container 105 further can be formed by placing the flange panel 206 of the crown blank 104 over the flange portions 175*a*, 175*b*, 175*c*, 175*d*, 177*a*, 177*b*, 177*c*, 177*d*, 179*a*, 179*b*, 179*c*, 179*d* of the base 101 so that the flange portions and the flange panel are in face-to-face contact (e.g., the flange portions are in face-to-face contact with the bottom surface of the flange panel). The flaps 210, 212, 214, 216, 226, 228, 230, 232, 242, 244, 246, 248 can be downwardly folded along their respective fold lines so that the flaps 210, 212, 214, 216, 226, 228, 230, 232, 242, 244, 246, 248 overlap the respective panels 127, 129, 135, 137, 143, 145, 151, 153, 159, 161, 167, 169 (FIGS. 3 and 4). In embodiments, the flaps 210, 212, 214, 216, 226, 228, 230, 232, 242, 244, 246, 248 and the panels 127, 129, 135, 137, 143, 145, 151, 153, 159, 161, 167, 169 cooperate to form a sidewall 264 of the container 105. Similarly, the flange portions 175*a*, 175*b*, 175*c*, 175*d*, 177*a*, 177*b*, 177*c*, 177*d*, 179*a*, 179*b*, 179*c*, 179*d* and the flange panel 206 can cooperate to form a flange 266 of the container 105, with the flange panel 206 providing a smooth, continuous upper surface of the flange 266. Accordingly, in embodiments, the crown 102 at least partially overlaps the base 101 when the base layer 107 of the container 105 is formed.

In embodiments, a liner material (not shown) can be applied over at least the sidewall 264, the bottom wall 260, and the divider 262 so that the liner material can form a liner 109 adhered to at least the overlapped flaps and panels of the sidewall 264, to the bottom panels 111, 113 of the bottom wall 260, and to the divider panels 117, 119 of the divider 262 along an interior 268 of the container 105. In embodiments, the liner 109 can be attached along at least a portion of the flange panel 206. In exemplary embodiments, the liner 109 can be adhered to the base layer 107 by a heat seal layer, adhesive, and/or other suitable features. In the illustrated embodiments, the attachment of the liner 109 to the base layer 107 can attach the flaps 210, 212, 214, 216, 226, 228, 230, 232, 242, 244, 246, 248 to the respective panels 127, 129, 135, 137, 143, 145, 151, 153, 159, 161, 167, 169 and can attach the overlap tabs 187 to the respective first bottom panel 111, first side panel 143, and second side panel 145. As shown in FIGS. 3 and 4, the flaps 210, 212, 214, 216, 226, 228, 230, 232, 242, 244, 246, 248 are smaller than the respective panels 127, 129, 135, 137, 143, 145, 151, 153, 159, 161, 167, 169 so that portions of each of the flaps and panels are in contact with the liner 109. In embodiments, the liner 109 can at least partially hold the crown 102 and the base 101 of the base layer 107 together and maintain the shape of the container 105. Alternatively, or in addition, one or more aspects of the base layer 107 can be attached by thermo-mechanical sealing, adhesive, etc.

Figure 5:
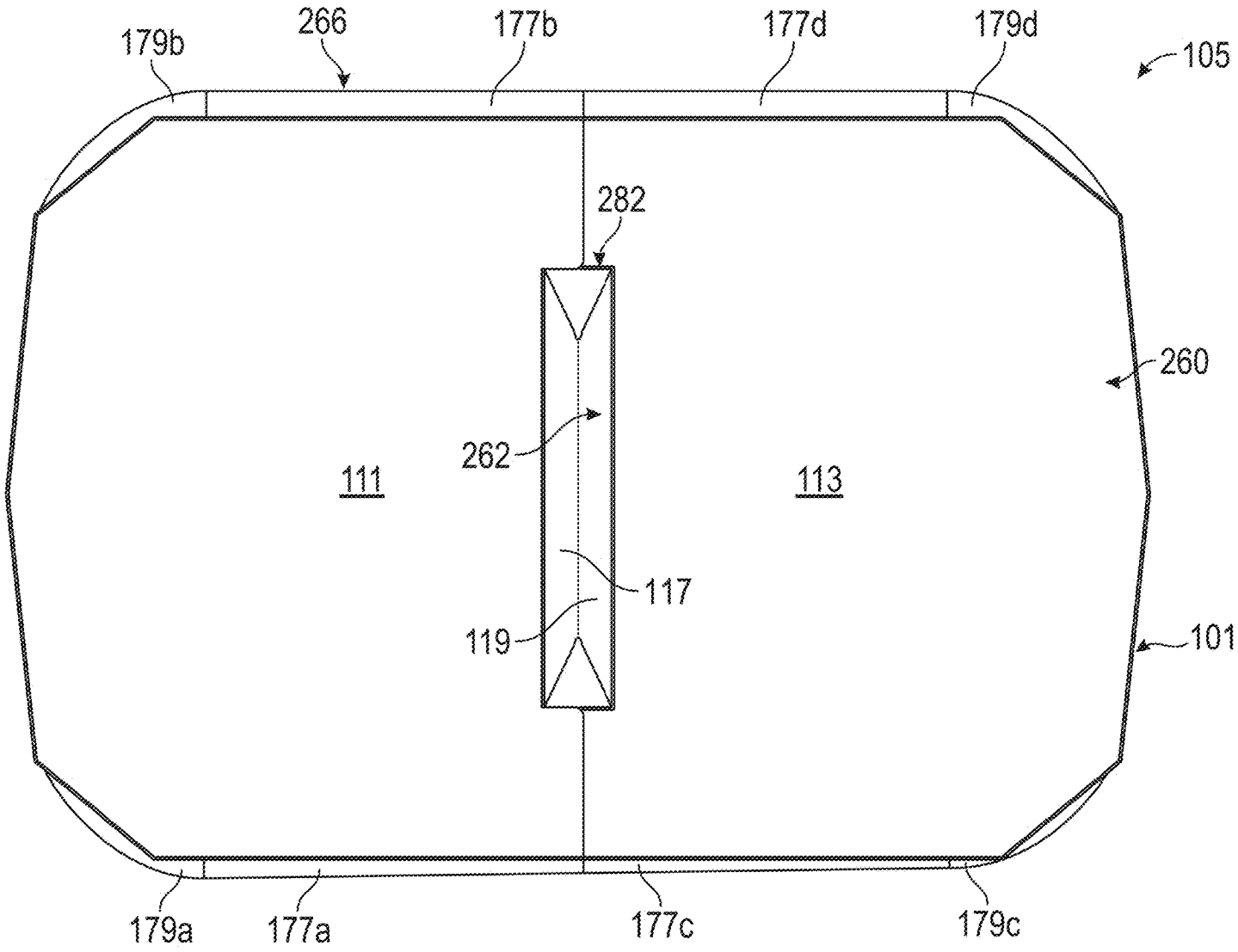
FIG. 5 is a perspective bottom view of the container of FIGS. 3 and 4.

As shown in FIGS. 3-5, the sidewall 264 and the bottom wall 260 extend around and at least partially define the interior 268 of the container 105, and the divider 262 extends upwardly into the interior 268 to at least partially form two interior portions of the container 105 for at least partially separating products held in the container 105. In the illustrated embodiments, the divider 262 can have a draft angle (e.g., the divider panels 117, 119 can extend obliquely from the respective lateral fold lines 121, 123 to the common lateral fold line 125). The draft angle of the divider 262 can facilitate stacking of the containers 105. For example, the divider 262 can at least partially define an opening 282 in the bottom wall 260 (FIG. 5) that can at least partially receive the divider 262 of a lower container 105 when the containers are stacked. In embodiments, the overlapping of the tabs 187 with the first bottom panel 111 and the side panels 143, 145 and/or the overlapping of the flaps 210, 212, 214, 216, 226, 228, 230, 232, 242, 244, 246, 248 with the respective panels 127, 129, 135, 137, 143, 145, 151, 153, 159, 161, 167, 169 can help increase the rigidity of the sidewall 264 and the bottom wall 260 of the container 105.

Figure 6:
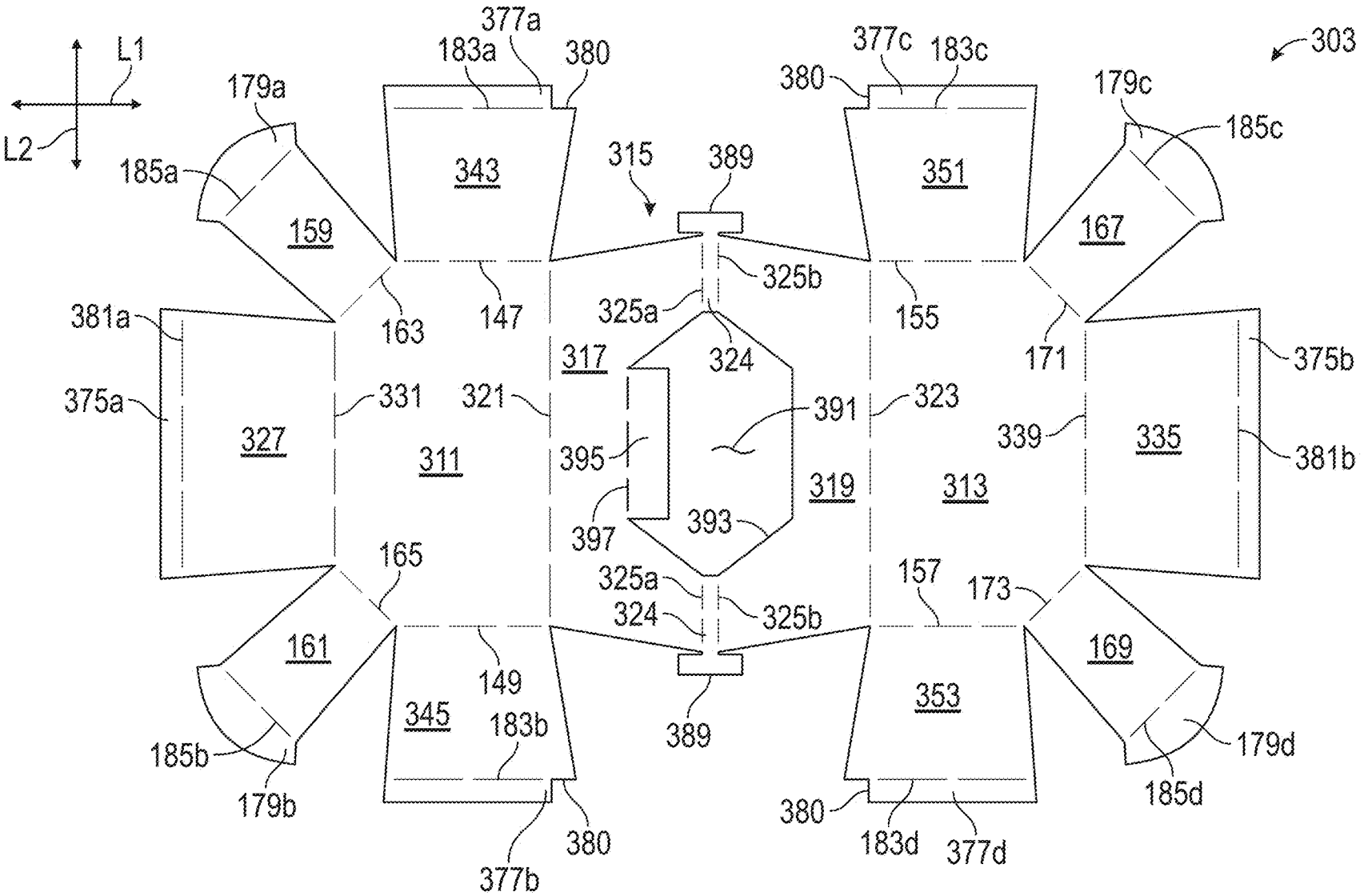
FIGS. 6 and 7 are plan views of a respective first blank and second blank used for forming a container according to further exemplary embodiments of the disclosure.
Figure 7:
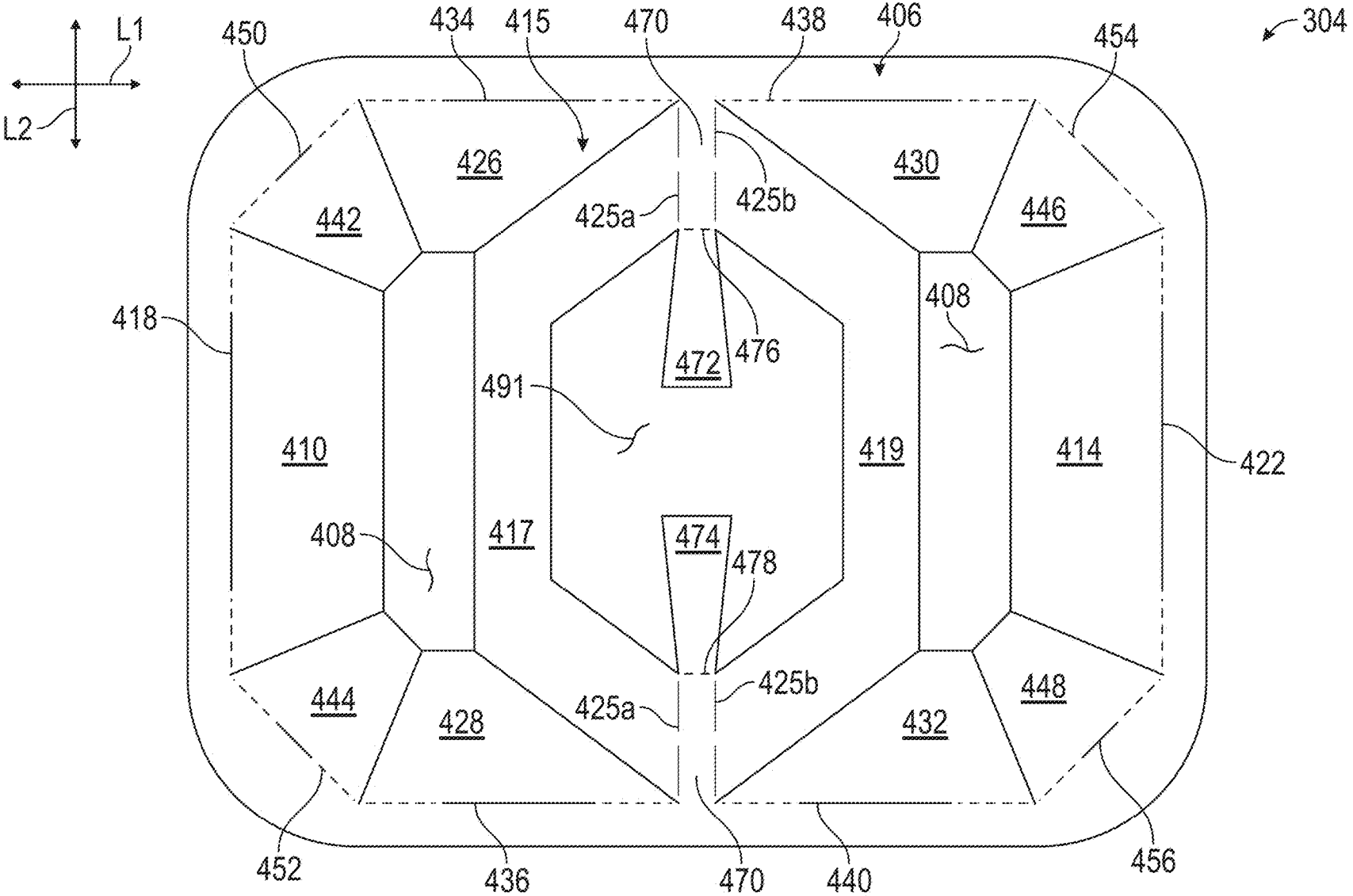

FIGS. 6 and 7 are plan views of a respective first or bottom or base blank 303 and second or top or crown blank 304 for forming a respective base 301 and crown 302, which cooperate to form a container 305 (FIGS. 10-16B) of a second embodiment of the disclosure (e.g., a container including a crown or crown component formed from the crown blank 304 and a bottom construct or component formed from the base blank 303, wherein the crown and the bottom construct can be secured together by at least a liner 309 to form a base layer 307). The second embodiment is generally similar to the prior embodiments, except for variations noted and variations that will be apparent to one of ordinary skill in the art. Accordingly, similar or identical features of the embodiments have been given like or similar reference numbers. As shown in FIG. 6, the base blank 303 is similar to the base blank 103 of the first embodiment except that the base blank 303 includes one end panel 327 foldably connected to the first bottom panel 311 along a lateral fold line 331 and one end panel 335 foldably connected to the second bottom panel 313 along a lateral fold line 339 (e.g., the second and fourth end panels 129, 137 of the base blank 103 are omitted in the base blank 303). As shown in FIG. 6, flange portions 375*a*, 375*b* are foldably connected to the respective first end panel 327 and second end panel 335 along respective lateral fold lines 381*a*, 381*b*. In the illustrated embodiments, the side panels 343, 345, 351, 353 of the base blank 303 have different shapes than the side panels 143, 145, 151, 153 of the base blank 103. For example, the tabs 187 are omitted in the base blank 303, and the side panels 343, 345, 351, 353 each have an oblique edge extending from the respective bottom panel 311, 313 to a respective notch 380 defined along the respective side panels 343, 345, 351, 353 and the respective flange portions 377*a*, 377*b*, 377*c*, 377*d*. Any of the bottom panels 311, 313, the end panels 327, 335, the side panels 343, 345, 351, 353, the corner panels 159, 161, 167, 169, and/or the flange portions 375*a*, 375*b*, 377*a*, 377*b*, 377*c*, 377*d*, 179*a*, 179*b*, 179*c*, 179*d* could be omitted or could be otherwise shaped, arranged, positioned, and/or configured without departing from the disclosure.

Figure 8:
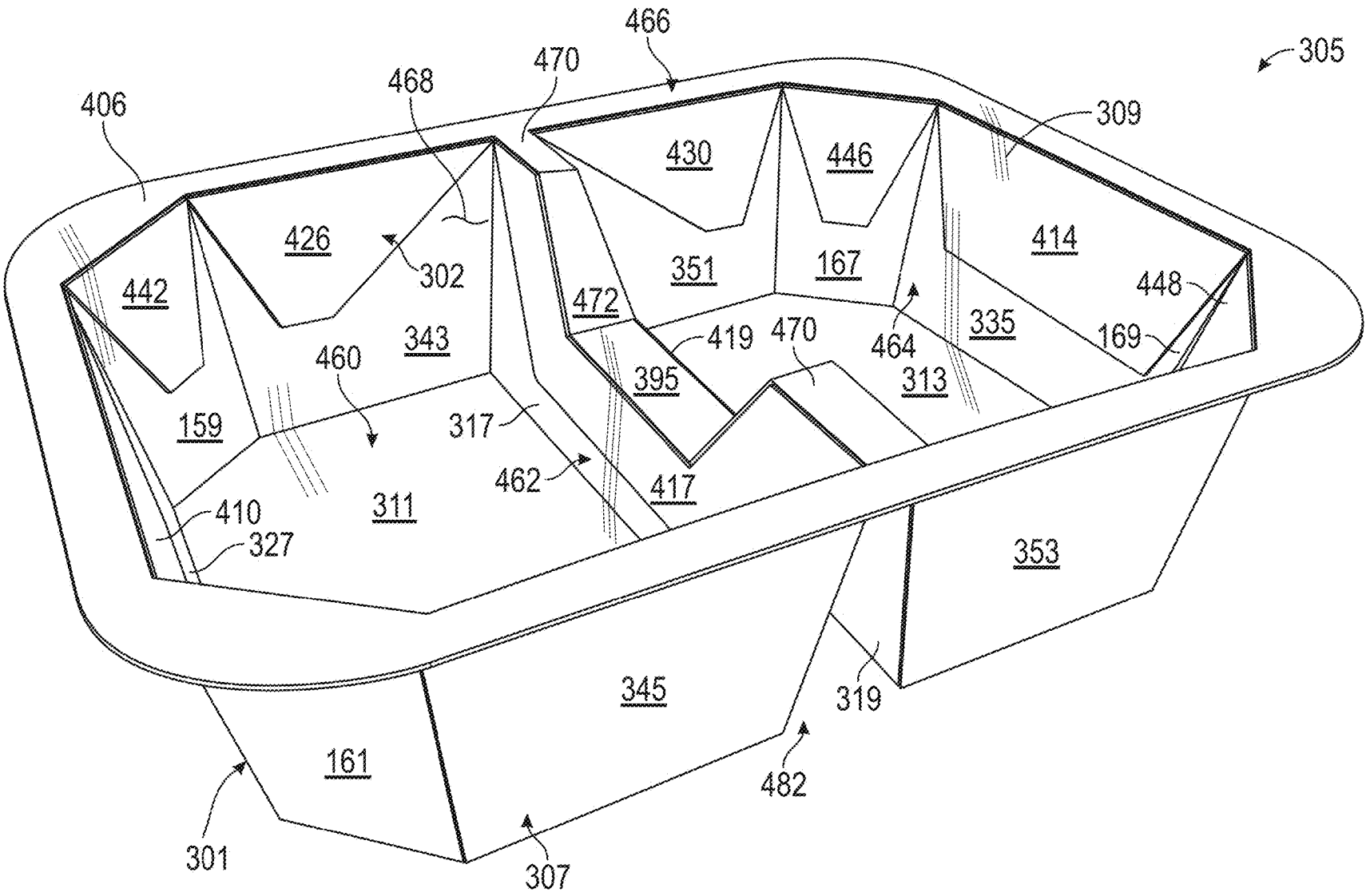
FIGS. 8 and 9 are perspective views of the container formed from the blanks of FIGS. 6 and 7 according to exemplary embodiments of the disclosure.
Figure 9:
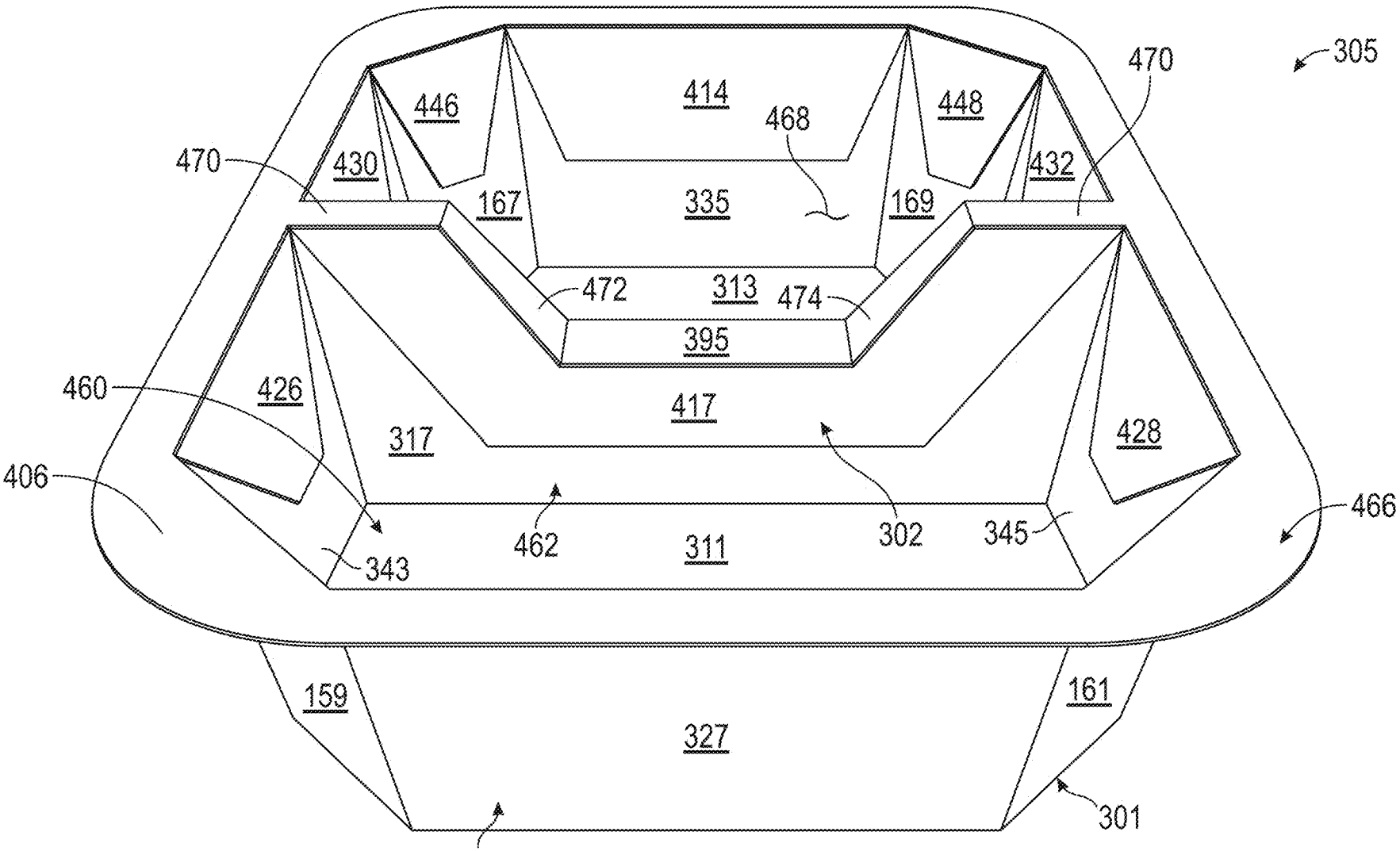

As shown in FIG. 6, the base blank 303 has a first divider structure 315 (e.g., a lower divider structure) for cooperating with a second divider structure 415 (e.g., an upper divider structure) in the crown blank 304 (FIG. 7) to form a divider 462 (FIGS. 8-11) as described in more detail below. In the illustrated embodiments, the first divider structure 315 can include a first divider panel 317 (e.g., a first lower divider panel) foldably connected to the first bottom panel 311 along a lateral fold line 321 and a second divider panel 319 (e.g., a second lower divider panel) foldably connected to the second bottom panel 313 along a lateral fold line 323. In embodiments, the first divider panel 317 is foldably connected to central panels 324 along lateral fold lines 325*a*, and the second divider panel 319 is foldably connected to the central panels 324 along lateral fold lines 325*b*. As shown in FIG. 8, the divider panels 317, 319 can have oblique outer edges that extend from the respective bottom panels 311, 313 to the central panels 324, wherein tabs 389 (e.g., rectangular tabs) can extend outwardly from the central panels 324 (e.g., the tabs 389 can be continuous with the central panels 324). In embodiments, the tabs 389 can cooperate with the flange portions of the base blank 303 when the flange 466 is formed as described in more detail below. As shown in FIG. 6, a divider opening 391 can extend in the divider structure 315 with an edge 393 extending along each of the divider panels 317, 319, and the central panels 324. In the illustrated embodiment, a central divider flap 395 is foldably connected to the first divider panel 317 along a lateral fold line 397 so that the central divider flap 395 extends along the divider opening 391. Any portion of the divider structure 315 could be omitted or could be otherwise shaped, arranged, positioned, and/or configured without departing from the disclosure. For example, the divider flap 395 could be foldably connected to the second divider panel 319.

As shown in FIG. 7, the flange panel 406 of the crown blank 304 is a different shape than the flange panel 206 of the crown blank 104 of the first embodiment. In the illustrated embodiments, the crown blank 304 has two end flaps 410, 414 foldably connected to the flange panel 406 along respective lateral fold lines 418, 422 and has a first side flap 426, a second side flap 428, a third side flap 430, and a fourth side flap 432 foldably connected to the flange panel 406 along respective longitudinal fold lines 434, 436, 438, 440. As shown in FIG. 7, corner flaps 442, 444, 446, 448 can be foldably connected to the flange panel 406 along respective oblique fold lines 450, 452, 454, 456. In embodiments, each of the flaps 410, 414, 426, 428, 430, 432, 442, 444, 446, 448 can be separable from the respectively adjacent flaps along respective tear or cut lines extending therebetween. Any of the flange panel 406, the end flaps 410, 414, the side flaps 426, 428, 430, 432, and/or the corner flaps 442, 444, 446, 448, could be omitted or could be otherwise shaped, arranged, positioned, and/or configured without departing from the disclosure.

In the illustrated embodiments, the second divider structure 415 of the crown blank 304 can include a third divider panel 417 (e.g., a first upper divider panel) and a fourth divider panel 419 (e.g., a second upper divider panel) each foldably connected to two extensions 470 of the flange panel 406 along respective lateral fold lines 425*a*, 425*b*. In embodiments, the extensions 470 can extend inwardly from the remainder of the flange panel 406 in the lateral direction L2. As shown in FIG. 7, the second divider structure 415 can include a divider opening 491 extending along the divider panels 417, 419. In the illustrated embodiments, the second divider structure 415 further can include two side divider flaps 472, 474 foldably connected to the respective extensions 470 along respective longitudinal fold lines 476, 479.

As shown in FIG. 7, the second divider structure 415 can extend across a central portion of the crown blank 304 with an opening 408 on either side of the second divider structure 425. In exemplary embodiments, the first opening 408 can extend along respective edges of the end flap 410, the side flaps 426, 428, the corner flaps 442, 444, and the third divider panel 417, and the second opening 408 can extend along respective edges of the end flap 414, the side flaps 430, 432, the corner flaps 446, 448, and the fourth divider panel 419. The crown blank 304 can be otherwise shaped, arranged, and/or configured without departing from the disclosure. In addition, any of the flange panel 406, the end flaps 410, 414, the side flaps 426, 428, 430, 432, the corner flaps 442, 444, 446, 448, and/or the second divider structure 415 could be omitted or could be otherwise shaped, arranged, positioned, and/or configured without departing from the disclosure.

When the container 305 is formed from the base blank 303 and the crown blank 304 (e.g., manually or by a forming tool), the bottom panels 311, 313 are moved closer together so that the divider panels 317, 319 are folded upwardly relative to the bottom panels 311, 313 along the lateral fold lines 321, 323, moving the central panels 324 upwardly while folding along the lateral fold lines 325*a*, 325*b*. In embodiments, the central panels 324 can remain parallel (e.g., generally and/or substantially parallel) with the bottom panels 311, 313. When the lower divider panels 317, 319 are in position (e.g., extending at least upwardly; e.g., upwardly at an oblique angle toward the central panels 324), the central divider flap 395 can be folded along the lateral fold line 397 so that the distal edge of the central divider flap 395 abuts the laterally extending edge of the divider panel 319 opposite to the lateral fold line 397.

Figure 10:
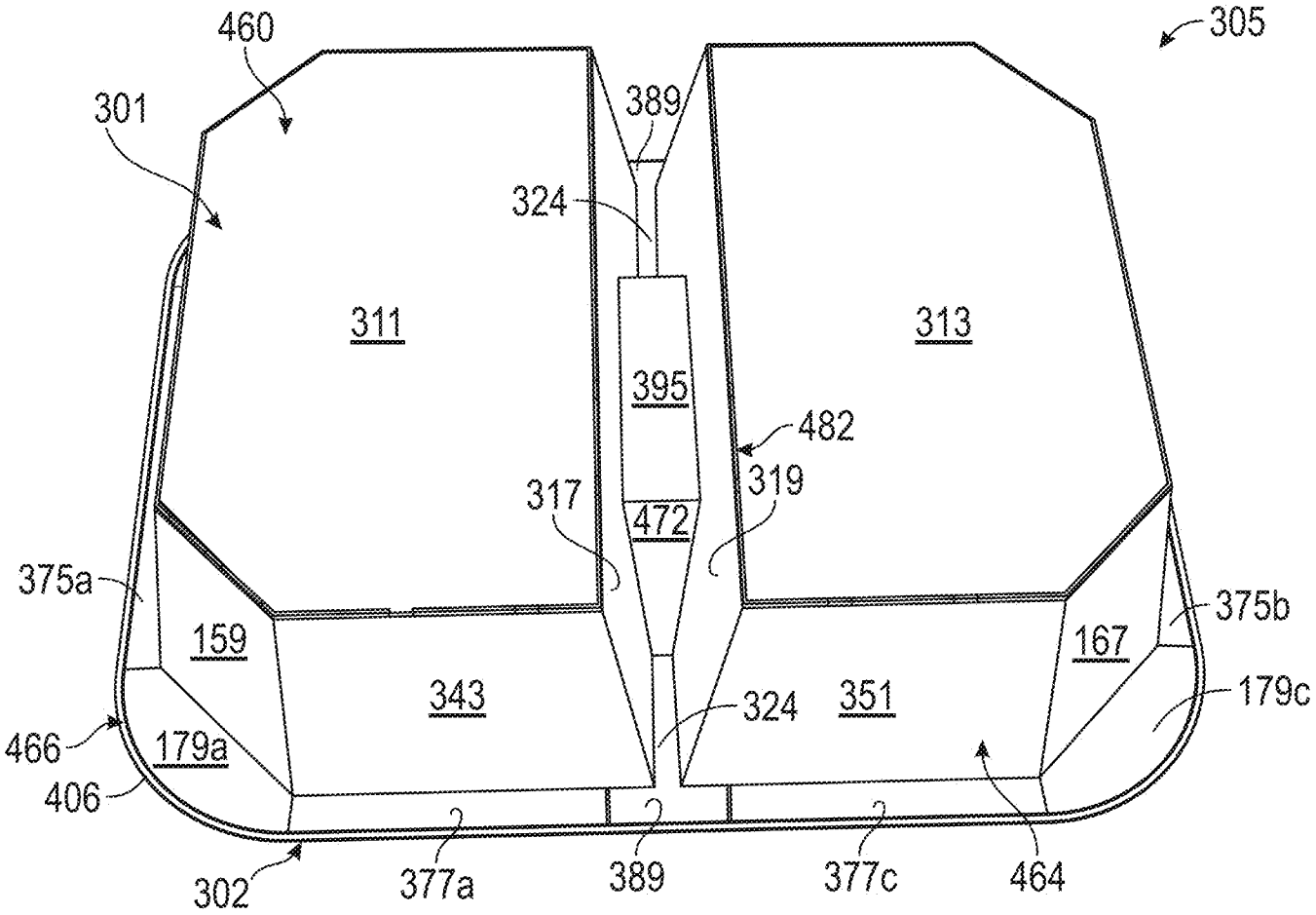
FIG. 10 is a perspective bottom view of the container of FIGS. 8 and 9.

The base construct 101 can be formed by folding the panels 327, 335, 343, 345, 351, 353, 159, 161, 167, 169 upwardly relative to the bottom panels 311, 313 along their respective fold lines and folding the flange portions 375*a*, 375*b*, 377*a*, 377*b*, 377*c*, 377*d*, 179*a*, 179*b*, 179*c*, 179*d* outwardly relative to the respective panels 327, 335, 343, 345, 351, 353, 159, 161, 167, 169. In the illustrated embodiments, the central panels 324 can be coplanar (e.g., generally and/or approximately coplanar) with the outwardly folded flange portions 375*a*, 375*b*, 377*a*, 377*b*, 377*c*, 377*d*, 179*a*, 179*b*, 179*c*, 179*d*, and the tabs 389 can be located in the notches 380 (e.g., as shown in FIG. 10) in the base construct. In embodiments, the panels 327, 335, 343, 345, 351, 353, 159, 161, 167, 169 can extend at least upwardly (e.g., upwardly and outwardly) from the bottom panels 311, 313, and the adjacent edges of the panels 327, 335, 343, 345, 351, 353, 159, 161, 167, 169 can abut one another (FIGS. 8-11). Further, the adjacent edges of the flange portions 375*a*, 375*b*, 377*a*, 377*b*, 377*c*, 377*d*, 179*a*, 179*b*, 179*c*, 179*d* can abut one another with the edges of the tabs 389 abutting the edges of the flange portions 377*a*, 377*b*, 377*c*, 377*d* (FIG. 14).

The container 305 further can be formed by placing the flange panel 406 of the crown blank 304 over the flange portions 375*a*, 375*b*, 377*a*, 377*b*, 377*c*, 377*d*, 179*a*, 179*b*, 179*c*, 179*d* so that the flange portions and the flange panel are in face-to-face contact (e.g., the flange portions are in face-to-face contact with the bottom surface of the flange panel). The flaps 410, 414, 426, 428, 430, 432, 442, 444, 446, 448 can be downwardly folded along their respective fold lines to form the crown and so that the flaps 410, 414, 426, 428, 430, 432, 442, 444, 446, 448 overlap the respective panels 327, 335, 343, 345, 351, 353, 159, 161, 167, 169 (FIGS. 10-13, 15, and 16A). In embodiments, the flaps 410, 414, 426, 428, 430, 432, 442, 444, 446, 448 and the panels 327, 335, 343, 345, 351, 353, 159, 161, 167, 169 cooperate to form a sidewall 464 of the container 305. Similarly, the flange portions 375*a*, 375*b*, 377*a*, 377*b*, 377*c*, 377*d*, 179*a*, 179*b*, 179*c*, 179*d* and the flange panel 406 can cooperate to form a flange 466 of the container 305, with the flange panel 406 providing a smooth, continuous upper surface of the flange 466.

As shown in FIGS. 8-11, the divider 462 can be formed in the container 305 when the crown blank 304 is placed over the bottom construct and the upper divider panels 417, 419 are folded downwardly along the respective lateral fold lines 425*a*, 425*b* to at least partially overlap the respective lower divider panels 317, 319. Further, the side divider flaps 472, 474 can be folded downwardly along the respective longitudinal fold lines 476, 478 so that the distal edges of the side divider flaps 472, 474 abut the respective longitudinally extending edges of the central divider flap 395 and the side edges of the side divider flaps 472, 474 abut the adjacent edges of the upper divider panels 417, 419 (FIGS. 8-11). Accordingly, in embodiments, the divider flaps 395, 472, 474 can at least partially close the at least partially aligned divider openings 391, 491 when the container 305 is formed.

In embodiments, a liner material (not shown) can be applied over at least the sidewall 464, the bottom wall 460, and the divider 462 so that the liner material can form a liner 309 (FIG. 8) adhered to at least the overlapped flaps and panels of the sidewall 464, to the bottom panels 311, 313 of the bottom wall 460, and to the divider panels 317, 319, 417, 419 and the divider flaps 395, 472, 474 of the divider 462 along an interior 468 of the container 305. In embodiments, the liner 309 can be attached along at least a portion of the flange panel 406. In exemplary embodiments, the liner 309 can be adhered to the base layer 307 by a heat seal layer, adhesive, and/or other suitable features. In the illustrated embodiments, the attachment of the liner 309 to the base layer 307 can attach the flaps 410, 414, 426, 428, 430, 432, 442, 444, 446, 448 to the respective panels 327, 335, 343, 345, 351, 353, 159, 161, 167, 169, can attach the upper divider panels 417, 419 to the respective lower divider panels 317, 319, and can help secure the divider flaps 395, 472, 474 in place in the divider 462. As shown in FIGS. 8-11, the flaps 410, 414, 426, 428, 430, 432, 442, 444, 446, 448 are smaller than the respective panels 327, 335, 343, 345, 351, 353, 159, 161, 167, 169 so that portions of each of the flaps and panels are in contact with the liner. In embodiments, the liner 309 can at least partially hold the portions of the base layer 307 together and maintain the shape of the container 305. Alternatively, or in addition, one or more aspects of the base layer 307 can be attached by thermo-mechanical sealing, adhesive, etc.

Figure 11:
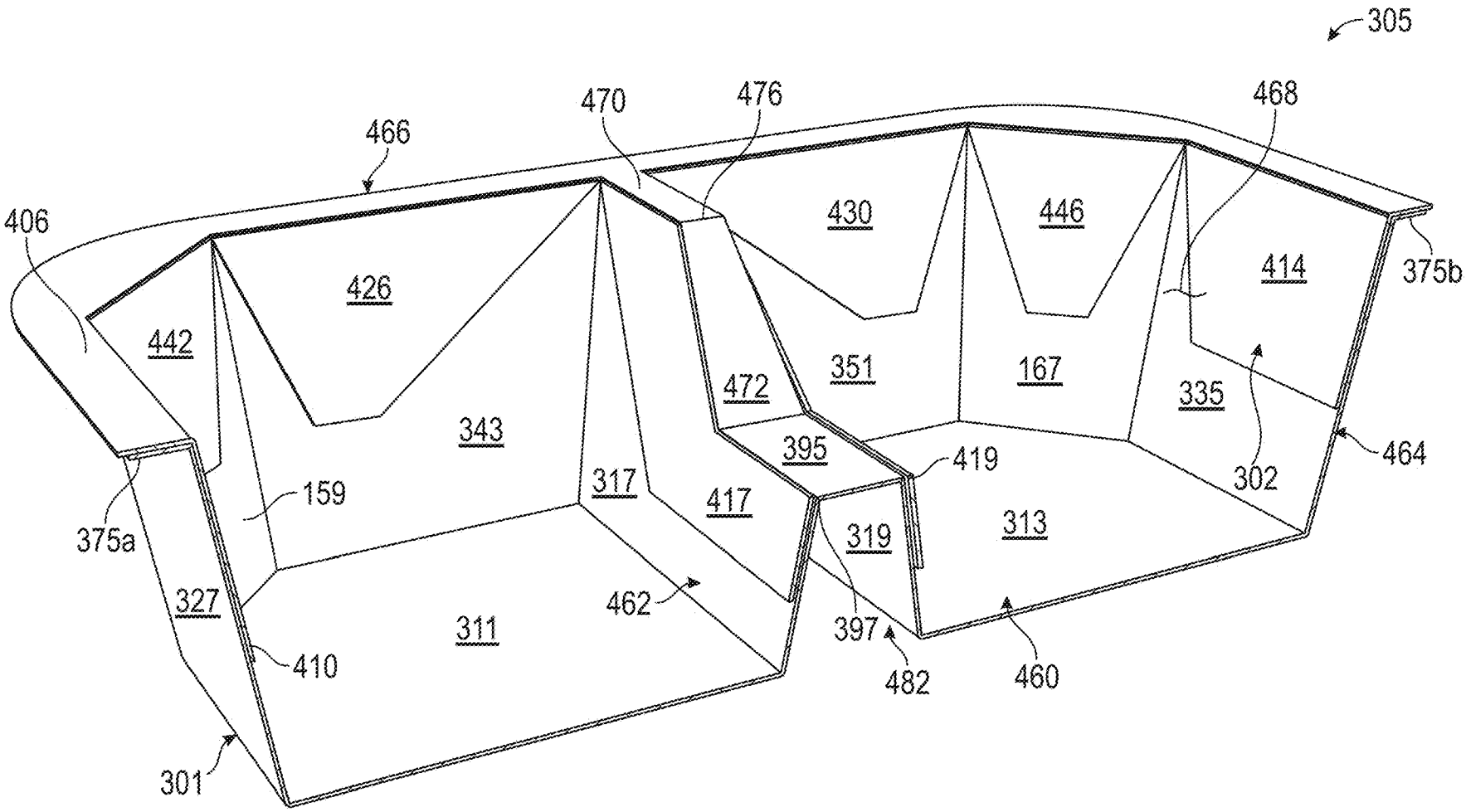
FIG. 11 is a perspective schematic cross-sectional view of the container of FIGS. 8-10.

As shown in FIGS. 8-11, the sidewall 464 and the bottom wall 460 extend around and at least partially define the interior 468 of the container 305, and the divider 462 extends upwardly into the interior 468 to at least partially form two interior portions (e.g., two receiving spaces) of the container 305 for at least partially separating products held in the container 305. As shown in FIGS. 8, 10, and 11, the divider 462 can at least partially define a recess 482 between the two bottom panels 311, 313 for at least partially receiving a divider 462 of a lower container 305 when the containers are stacked.

In embodiments, the container 305 with the integrated divider 462 can be formed in a single process, and the shape of the divider 462 can help maintain the rigidity and/or the integrity of the container 305 without intruding into the sealing area of the container 305. The container 305 can provide a paper-based tray wherein the divider 462 facilitates the separation of products contained in the tray and wherein the container 305 can replace plastic trays.

All dimensional information presented herein is intended to be illustrative of certain aspects, features, etc., of various embodiments of the disclosure, and is not intended to limit the scope of the disclosure. The dimensions of the blanks, containers, forming tools, features, or any other dimension, can be more or less than what is shown and described in this disclosure without departing from the scope of this disclosure and can be within the listed ranges of dimensions for each feature or outside the listed ranges of dimensions for each feature without departing from the scope of this disclosure.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In general, the blanks may be constructed from paperboard having a caliper so that it is heavier and more rigid than ordinary paper. The blank can also be constructed of other materials, such as cardboard, or any other material having properties suitable for enabling the carton to function at least generally as described above. The blanks can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

In accordance with the exemplary embodiments, a fold line can be any substantially linear, although not necessarily straight, form of weakening that facilitates folding thereal-ong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, and alterations, etc., of the above-described embodiments. Additionally, the disclosure shows and describes only selected embodiments, but various other combinations, modifications, and environments are contemplated and are within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments without departing from the scope of the disclosure.

What is claimed is:

1. A container for holding one or more articles, the container comprising:

a base comprising one or more bottom panels and one or more divider panels;

a crown comprising a flange panel;

a bottom wall comprising at least the one or more bottom panels;

a sidewall comprising at least a portion of the base and at least a portion of the crown, wherein the sidewall and the bottom wall extend along an interior of the container;

a flange comprising the flange panel, the flange extending outwardly from the sidewall; and a divider comprising the one or more divider panels, the divider extending upwardly from the bottom wall into the interior of the container, the crown at least partially overlaps the base, the base comprises at least one base panel foldably connected to the bottom wall, the crown comprises at least one crown flap foldably connected to the flange panel, and the at least one crown flap at least partially overlaps the at least one base panel to at least partially form the sidewall of the container.

2. The container of claim 1, wherein the one or more bottom panels comprise a first bottom panel and a second bottom panel, the one or more divider panels comprise a first divider panel foldably connected to the first bottom panel and a second divider panel foldably connected to the second bottom panel, and the first divider panel and the second divider panel extend from the respective first bottom panel and second bottom panel into the interior of the container.

3. The container of claim 2, wherein the first divider panel is foldably connected to the second divider panel along a fold line.

4. The container of claim 3, wherein the fold line is a first fold line, the first divider panel is foldably connected to the first bottom panel along a second fold line, and the second divider panel is foldably connected to the second bottom panel along a third fold line, and wherein the second fold line and the third fold line are spaced apart from one another.

5. The container of claim 2, wherein the bottom wall further comprises one or more overlap tabs extending from the second bottom panel, and wherein the overlap tabs are in an at least partially overlapping relationship with the first bottom panel.

6. The container of claim 2, wherein the sidewall comprises a first side panel foldably connected to the first bottom panel and a second side panel foldably connected to the second bottom panel, wherein the container further comprises one or more overlap panels extending from each of the second bottom panel and the second side panel, and wherein the one or more overlap panels extending from the second bottom panel at least partially overlap the first bottom panel and the one or more overlap panels extending from the second side panel at least partially overlap the first side panel.

7. The container of claim 2, wherein each of the first divider panel and the second divider panel is foldably connected to a first central panel and a second central panel, and wherein the first central panel and the second central panel are spaced apart from one another.

8. The container of claim 7, wherein a central divider flap is foldably connected to the first divider panel and extends to the second divider panel, and wherein the central divider flap is downwardly spaced apart from the first central panel and the second central panel.

9. The container of claim 2, wherein the first divider panel is foldably connected to a central panel and the second divider panel is foldably connected to the central panel opposite to the first divider panel, and wherein the central panel is spaced apart from the bottom wall.

10. The container of claim 9, wherein a central divider flap is foldably connected to the first divider panel and extends to the second divider panel, and wherein the central divider flap is spaced apart from the central panel.

11. The container of claim 9, wherein the base comprises the central panel, and wherein the crown comprises a third divider panel and a fourth divider panel cooperating with at least the first divider panel and the second divider panel to at least partially form the divider of the container.

12. The container of claim 11, wherein each of the third divider panel and the fourth divider panel is foldably connected to an extension of the flange panel, the extension at least partially overlapping the central panel of the base.

13. The container of claim 12, wherein the third divider panel and the fourth divider panel at least partially overlap the respective first divider panel and second divider panel.

14. The container of claim 12, wherein the divider further comprises a side divider flap foldably connected to the extension and a central divider flap foldably connected to the first divider panel, wherein the central divider flap extends from the first divider panel to the second divider panel, and wherein the side divider flap extends from the extension to the central divider flap.

15. The container of claim 14, wherein the side divider flap extends downwardly and inwardly from the extension to the central divider flap, and the central divider flap is spaced upwardly from the first bottom panel and the second bottom panel.

16. The container of claim 1, wherein the divider at least partially defines a recess in the bottom wall for at least partially receiving a divider of another container when the containers are arranged in a stack.

17. The container of claim 1, wherein the at least one base panel is a plurality of base panels foldably connected to the bottom wall, and the at least one crown flap is a plurality of crown flaps foldably connected to the flange panel, and wherein crown flaps of the plurality of crown flaps at least partially overlap respective base panels of the plurality of base panels to at least partially form the sidewall of the container.

18. The container of claim 1, further comprising a liner attached to at least a portion of the crown and to at least a portion of the base along at least a portion of the sidewall, at least a portion of the bottom wall, and at least a portion of the divider, wherein the liner at least partially secures the crown and the base together.

19. In combination, a base blank and a crown blank for forming a container for holding one or more articles, the base blank comprising one or more bottom panels and one or more divider panels, wherein the one or more bottom panels are for at least partially forming a bottom wall of the container formed from the base blank and the crown blank, and the one or more divider panels are for at least partially forming a divider of the container formed from the base blank and the crown blank, and wherein the one or more divider panels are for extending upwardly from one or more bottom panels when the container is formed from the base blank and the crown blank; and the crown blank comprising at least a flange panel for at least partially forming a flange of the container formed from the base blank and the crown blank;

wherein at least a portion of the base blank and at least a portion of the crown blank are for at least partially forming a sidewall of the container formed from the base blank and the crown blank, the base blank comprises at least one base panel foldably connected to the one or more bottom panels, the crown blank comprises at least one crown flap foldably connected to the flange panel, and the at least one crown flap is for at least partially overlapping the at least one base panel to at least partially form the sidewall when the container is formed from the base blank and the crown blank.

20. The combination of claim 19, wherein the one or more bottom panels comprise a first bottom panel and a second bottom panel, and the one or more divider panels comprise a first divider panel foldably connected to the first bottom panel and a second divider panel foldably connected to the second bottom panel.

21. The combination of claim 20, wherein the first divider panel is foldably connected to the second divider panel along a fold line.

22. The combination of claim 21, wherein the fold line is a first fold line, the first divider panel is foldably connected to the first bottom panel along a second fold line, and the second divider panel is foldably connected to the second bottom panel along a third fold line, and wherein the second fold line and the third fold line are spaced apart from one another.

23. The combination of claim 20, wherein the base blank further comprises one or more overlap tabs extending from the second bottom panel, and wherein the overlap tabs are for being in an at least partially overlapping relationship with the first bottom panel when the container is formed from the base blank and the crown blank.

24. The combination of claim 20, wherein the base blank comprises a first side panel foldably connected to the first bottom panel, a second side panel foldably connected to the second bottom panel, and one or more overlap panels extending from each of the second bottom panel and the second side panel, and wherein the one or more overlap panels extending from the second bottom panel are for at least partially overlapping the first bottom panel when the container is formed from the base blank and the crown blank and the one or more overlap panels extending from the second side panel are for at least partially overlapping the first side panel when the container is formed from the base blank and the crown blank.

25. The combination of claim 20, wherein each of the first divider panel and the second divider panel is foldably connected to a first central panel and a second central panel, and wherein the first central panel and the second central panel are spaced apart from one another.

26. The combination of claim 25, wherein the first divider panel, the second divider panel, the first central panel, and the second central panel extend along a divider opening in the base blank, and wherein a central divider flap is foldably connected to the first divider panel along the divider opening and extends toward the second divider panel.

27. The combination of claim 20, wherein the first divider panel is foldably connected to a central panel and the second divider panel is foldably connected to the central panel opposite to the first divider panel, and wherein the central panel is spaced apart from the first bottom panel and the second bottom panel by the respective first divider panel and second divider panel.

28. The combination of claim 27, wherein a central divider flap is foldably connected to the first divider panel and extends toward the second divider panel, and wherein the central divider flap is spaced apart from the central panel.

29. The combination of claim 27, wherein the base blank comprises the central panel, and wherein the crown blank comprises a third divider panel and a fourth divider panel for cooperating with at least the first divider panel and the second divider panel to at least partially form the divider when the container is formed from the base blank and the crown blank.

30. The combination of claim 29, wherein each of the third divider panel and the fourth divider panel is foldably connected to an extension of the flange panel, the extension being for at least partially overlapping the central panel of the base blank when the container is formed from the base blank and the crown blank.

31. The combination of claim 30, wherein the crown blank further comprises a side divider flap foldably connected to the extension and the base blank further comprises a central divider flap foldably connected to the first divider panel, wherein the central divider flap and the side divider flap are for cooperating with the first divider panel, the second divider panel, the third divider panel, and the fourth divider panel to at least partially form the divider when the container is formed from the base blank and the crown blank.

32. The combination of claim 20, wherein the at least one base panel is a plurality of base panels foldably connected to at least one of the first bottom panel and the second bottom panel, and the at least one crown flap is a plurality of crown flaps foldably connected to the flange panel, and wherein crown flaps of the plurality of crown flaps are for at least partially overlapping respective base panels of the plurality of base panels to at least partially form the sidewall when the container is formed from the base blank and the crown blank.

33. A method of forming a container for holding one or more articles, the method comprising:

obtaining a base blank and a crown blank, wherein the base blank comprises one or more bottom panels and one or more divider panels, and wherein the crown blank comprises at least a flange panel;

forming the base blank into a base comprising positioning the one or more bottom panels to at least partially form a bottom wall extending along an interior of the container; and forming the crown blank into a crown at least partially overlapping the base, wherein portions of the crown and the base cooperate to at least partially form a sidewall extending at least partially around the interior of the container, and wherein the flange panel at least partially forms a flange extending outwardly from the sidewall; and forming a divider comprising positioning the one or more divider panels to extend at least upwardly from the bottom wall, the base blank comprises at least one base panel foldably connected to the one or more bottom panels, the crown blank comprises at least one crown flap foldably connected to the flange panel, and the forming the crown blank into the crown comprising positioning the at least one crown flap to at least partially overlap the at least one base panel to at least partially form the sidewall of the container.

34. The method of claim 33, wherein the one or more bottom panels comprise a first bottom panel and a second bottom panel, and the one or more divider panels comprise a first divider panel foldably connected to the first bottom panel and a second divider panel foldably connected to the second bottom panel, and wherein the positioning the one or more divider panels comprises positioning the first bottom panel and the second bottom panel to extend from the respective first bottom panel and the second bottom panel into the interior of the container.

35. The method of claim 34, wherein the base blank comprises a first side panel foldably connected to the first bottom panel, a second side panel foldably connected to the second bottom panel, and one or more overlap panels extending from each of the second bottom panel and the second side panel, wherein the forming the base blank into the base further comprises positioning the first bottom panel and the second bottom panel relative to one another so that the one or more overlap panels extending from the second bottom panel at least partially overlap the first bottom panel and positioning the first side panel and the second side panel relative to one another so that the one or more overlap panels extending from the second side panel at least partially overlap the first side panel.

36. The method of claim 34, wherein the first divider panel is foldably connected to a central panel and the second divider panel is foldably connected to the central panel opposite to the first divider panel, and wherein forming the divider further comprises folding the first divider panel and the second divider panel relative to the bottom wall and relative to the central panel while positioning the central panel to be spaced apart from the bottom wall.

37. The method of claim 36, wherein the base blank further comprises a central divider flap foldably connected to the first divider panel, and wherein the forming the divider further comprises folding the central divider flap relative to the first divider panel so that the central divider flap extends from the first divider panel to the second divider panel, the central divider flap being spaced apart from the central panel.

38. The method of claim 36, wherein the base blank comprises the central panel, and the crown blank comprises a third divider panel and a fourth divider panel each foldably connected to an extension of the flange panel, and wherein the forming the divider further comprises positioning the extension of the flange panel, the third divider panel, and the fourth divider panel to at least partially overlap the respective central panel, first divider panel, and second divider panel.

39. The method of claim 34, wherein the at least one base panel is a plurality of base panels foldably connected to at least one of the first bottom panel and the second bottom panel, and the at least one crown flap is a plurality of crown flaps foldably connected to the flange panel, and wherein the forming the crown blank into the crown comprises positioning crown flaps of the plurality of crown flaps to at least partially overlap respective base panels of the plurality of base panels to at least partially form the sidewall of the container.

40. The method of claim 33, further comprising attaching a liner material to at least a portion of the crown and to at least a portion of the base to at least partially form a liner along at least a portion of the sidewall, at least a portion of the bottom wall, and at least a portion of the divider, wherein the liner at least partially secures the crown and the base together.

* * * * *